US010036166B1

(12) United States Patent
Heo

(10) Patent No.: US 10,036,166 B1
(45) Date of Patent: Jul. 31, 2018

(54) PROTECTIVE CAP FOR GABLE END OF ROOF RIDGE

(71) Applicant: Bal Heo, Alpharetta, GA (US)

(72) Inventor: Bal Heo, Alpharetta, GA (US)

( * ) Notice: Subject to any disclaimer, the term of this patent is extended or adjusted under 35 U.S.C. 154(b) by 0 days.

(21) Appl. No.: 15/494,524

(22) Filed: Apr. 23, 2017

Related U.S. Application Data

(63) Continuation-in-part of application No. 15/446,232, filed on Mar. 1, 2017.

(51) Int. Cl.
*E04D 1/30* (2006.01)
*E04D 13/00* (2006.01)
*E04B 1/72* (2006.01)

(52) U.S. Cl.
CPC ..... *E04D 13/004* (2013.01); *E04B 1/72* (2013.01); *E04D 1/30* (2013.01); *E04D 2001/302* (2013.01); *E04D 2001/304* (2013.01); *E04D 2001/305* (2013.01)

(58) Field of Classification Search
CPC ..... E04D 13/004; E04D 2001/302; E04D 13/158; E04D 13/1585; E04D 13/174; E04D 1/30; E04D 2001/304; E04D 2001/305; F24F 7/02; E04B 1/72
See application file for complete search history.

(56) References Cited

U.S. PATENT DOCUMENTS 3,381,425 A 5/1968 Gabel
4,073,106 A 2/1978 Malott
4,233,786 A * 11/1980 Hildreth ..... E04D 13/1585 52/556
4,501,097 A 2/1985 Rosenkilde
4,965,976 A 10/1990 Riddle et al.
5,772,502 A 6/1998 Smith
5,797,222 A * 8/1998 Martin ..... E04D 13/174 454/365
6,125,602 A * 10/2000 Freiborg ..... E04D 1/265 52/198
6,182,400 B1 * 2/2001 Freiborg ..... E04D 1/30 52/276
6,277,024 B1 8/2001 Coulton
9,631,368 B1 * 4/2017 Heo ..... E04D 13/004
2004/0074158 A1 * 4/2004 De Zen ..... E04L 31/12 52/79.9
2013/0059524 A1 * 3/2013 Henderson ..... E04D 13/174 454/365
2013/0344796 A1 * 12/2013 Rossetta ..... E04D 13/174 454/365
2014/0357181 A1 * 12/2014 Stouffer ..... E04D 13/174 454/367

* cited by examiner

*Primary Examiner* — Andrew J Triggs
(74) *Attorney, Agent, or Firm* — Young Jeon

(57) ABSTRACT

Roof ridge end caps are installed at the highest elevations of the peaks of gabled roofs to prevent damage caused by the roosting habits of birds. Exemplary roof ridge end caps of the invention include a roof ridge end cap peak formed by angularly connected side panels, opposed and adjustable face panels that may be moved apart or together to adjust the angle at the peak and a tail portion, each of which provides a further covering function to the area around a roof peak. Also disclosed are methods of installing the roof ridge end caps to prevent bird damage and deterioration at the peak edges of a roof in which the roof ridge end cap is attached in a clockwise rotational displacement to the face of the building fascia to secure it over the roof tip.

8 Claims, 7 Drawing Sheets

3
10
2a
1
100
Z
X
Y
Y
X
Z

PROTECTIVE CAP FOR GABLE END OF ROOF RIDGE

This application is a continuation-in-part of U.S. patent application Ser. No. 15/446,232, filed Mar. 1, 2017, the entire disclosure of which is herein incorporated by reference in its entirety.

TECHNICAL FIELD

This application relates to devices and methods for preventing pecking damage by birds at elevated roof points of gabled roofs. Roof ridge end caps according to the various embodiments of the invention provide an impermeable, impenetrable and protective covering that prevents birds from pecking away shingles at the roof peaks. The methods of installing the roof ridge end caps conveniently provide easy covering of the roof peaks.

BACKGROUND

Roofing may be constructed of various materials, examples of which include asphalt shingles, composite shingles or panels, or metal panels. The roof is an expensive investment in residential or commercial construction, and roofing installations are expected to last for up to several decades. Because of its elevation and exposure, the roofs are susceptible to environmental damage from extreme weather conditions such as high winds, prolonged layering of ice, snow weight and hail. These elements cause the roofing materials to be eroded or to become dislodged at installation points and the seams so that the impermeability of the roof construction is breached, and the resulting ingress of water and pests becomes a further source of damage. Pest damage is a significant cause of roofing loss or early deterioration. In particular birds, as their habit, seek out elevated perches and often choose the eaves, i.e. the edges of a roof which overhang and project beyond the walls that form the sides of a building, and the peaks and ridges of the roof gables, which are the high points at the intersections of roofing panels on a pitched roof. While the birds use these points of elevation as perches, they also nibble on particles from the roof, for example pebbles of asphalt from the shingles. Eating small indigestible particles aids the birds' digestion. This bird behavior is ubiquitous and a major factor in the characterization of birds as pests by the construction industry. Their continued pecking at the edges of the eaves and ridges cause a gradual, premature deterioration of the roofing materials over time, which is referred to herein as "bird damage." In addition, the plucking away at these exposed areas of the roof can create openings through which birds and other pests can enter and create undesirable and unsanitary nests beneath the roof covering. Further, bird droppings can also negatively affect the roof. Birds eat an acidic diet, including the roofing materials, which are made of tar. Because of this acidic diet, the birds' droppings are also acidic. The droppings on the roof over time eventually eat away at the roofing shingles and sheathing. If left unattended, the presence of droppings will cause the roofing materials to deteriorate, and the roof will leak and cause deterioration in the building structure.

The methods that have been used to deter bird roosting on sensitive roofing areas have involved using repellent structures and materials or limiting physical accessibility to the roof elevations. According to the International Association of Certified Home Inspectors, owners of commercial buildings, which can suffer extensive bird damage at great financial losses, have resorted to devices such as bird spikes which involve installing numerous metal wires or spikes close together to form a porcupine-like arrangement pointed wires that discourage bird landings. An electric low-voltage current may also be run through the wires. These are expensive methods as the wires and electrical systems are difficult and time-consuming to install, and the obvious appearance on the roofing profile, especially in the case of residential roofing, is undesirable. Alternatively, scare devices such as balloons or animal images or characters can for a while deter bird approach; however after a while the birds overcome their apprehension at the presence of a static figure. The deterrent effect is reduced and the problem resumes. Another deterrent method includes applying a repellent liquid or paste to the roofing surface. These methods will require continual reapplication for the deterrent effect to be persistent. The foregoing bird repellent systems require significant additional expense and their effect is not permanent.

There is therefore a need in the field of roofing materials and installation for apparatuses, materials and methods that prevent roosting of bird pests, or alternatively prevent the damaging effects of bird roosting at the elevation points of roofs. Preferably, the needed solution would provide a protective covering that is durable, impermeable and made of a material than cannot be nibbled away by the birds themselves or otherwise eroded or degraded over time by environmental exposure. Further, such a solution should desirably provide protection over all the outermost elements of eave and ridge edges at the high points of a roof to provide a protective covering against the damage from bird perching. The most practical solution should also minimize the installation process and the need to puncture the roof materials with nails, which could lead to seepage of water beneath the shingles and into the building structure. Such a solution is presented by the apparatuses and methods of the present invention.

SUMMARY OF INVENTION

The present invention comprises a roof ridge end cap that includes two side panels, each further including a front edge, a top edge and a side edge, wherein the two side panels are joined at the top edges thereof at an angle to form a peak; two face panels, each of which is attached to the front edge of one side panel, wherein the two face panels intersect at an intersection area, and further wherein the two face panels move cooperatively one in relation to the other to narrow or widen the angle of the peak; a tail portion which is formed as an extension of the side panels distally from the face panels, and wherein the length of each side panel is progressively shortened in relation to the length from the front edge to the tail portion; and a tail plate formed as the distal end of the tail portion. The roof ridge end cap further comprises an attachment means for fastening the roof ridge end cap to the peak of a gabled roof. In other embodiments, the roof ridge end cap comprises hooded panels that overhang the face panels at the peak of the roof ridge end cap. The hooded roof ridge end cap so formed provides additional protection to the roof peak by creating an extension of each side panel that protrudes horizontally out and away from the corresponding face panel and the side wall of the building structure beneath the roof peak. This in turn further removes access by roosting birds to the materials of the roof peak.

The invention additionally comprises a method of installing a roof ridge end cap to prevent bird damage at a roof peak of a building structure that includes opposed side panels of a roof gable which are connected at the roof peak, said roof peak including an exposed tip; a fascia connecting the side panels of the roof gable at the ends thereof; and a roof ridge that extends along the roof peak, the method comprising the steps of measuring the angle at the tip of a roof peak; placing a roof ridge end cap over the tip of the roof peak, such a roof ridge end cap being comprised of: two side panels, each comprising a front edge, a top edge and a side edge, further wherein the two side panels are joined at the top edges thereof at an angle to form a roof ridge end cap peak, wherein said roof ridge end cap peak comprises an outer surface and an inner surface and an adjustable angle between the side panels; two face panels, each of which is attached to the front edge of one side panel, wherein the two face panels intersect at an intersection area, and further wherein the two face panels move cooperatively one in relation to the other to narrow or widen the angle of the peak; a tail portion which is formed as an extension of the side panels and distally from the face panels, and wherein the length of each side panel is progressively shortened in relation to the length from the front edge to the tail portion; and an attachment point for an attachment or fastener means located in the intersection area between the face panels; wherein the roof ridge end cap peak comprises a displacement gap between the inner surface of the roof ridge end cap peak and the tip of a roof peak of the building structure over which the roof ridge end cap is applied; and attaching the roof ridge end cap to the roof peak at the attachment point by driving a fastener along a Z-axis through the displacement gap into the building fascia.

The invention also comprises methods of installing roof ridge end caps of the invention using a single attachment point or multiple attachment points. These methods represent an alternative to and further improvement of the installation method disclosed and claimed in U.S. Pat. No. 9,631,318. In this regard, the installation method may comprise a single point of attachment at the intersection of the face panels which is an additional and alternative method to the method previously disclosed in currently pending U.S. application Ser. No. 15/446,232. In that application is disclosed an installation method comprising driving an attachment means downward at an angle through the intersection between the face panels of a roof ridge end cap into the fascia of a roof gable. Alternatively, as also disclosed in this application, the installation method comprises attaching the roof ridge end cap to the building at a single or multiple points of attachment by driving the attachment means forward into the fascia along a center line axis. In particular, the roof ridge end cap is rotated clockwise around a center line X-axis as a fastener, for example a screw, which has been inserted through the face panels is progressively tightened. The rotation of the cap as it is being attached causes the cap to be pushed down and seated firmly along the roof ridge of the building structure, and the full insertion of the fastener then locks the cap, which has been shifted into an optimal position during the clockwise rotation, into place. Further, a gap formed by the peak dimensions of the roof ridge end cap in relation to the roof peak itself provides a gap, i.e. a pocket of space between the inside of the roof ridge end cap peak and the roof peak, through which the fastener passes as it is being tightened. This gap facilitates the clockwise turning of the roof ridge end cap into a locked position; and the movement of the fastener through the gap generates a downward pressure on the tail end of the cap that also contributes to the entire cap being securely seated on the roof peak.

DESCRIPTION OF EMBODIMENTS

Figure 5:
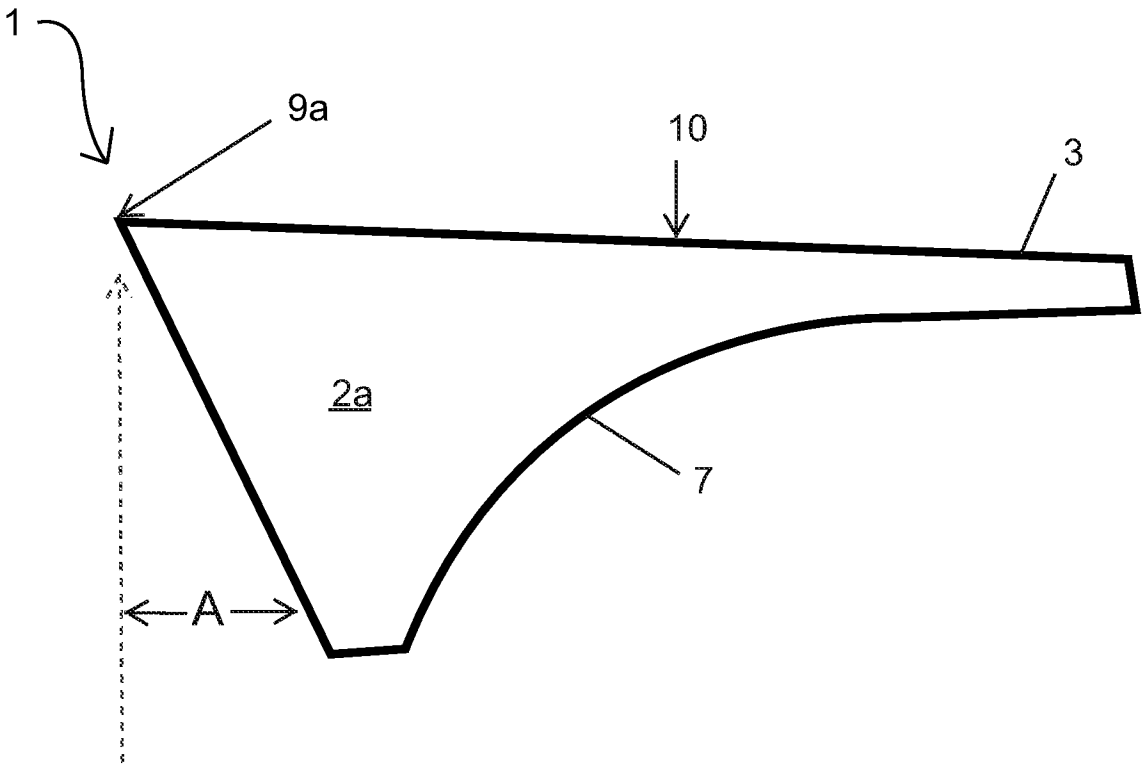
FIG. 5 is a side view of a roof ridge end cap according to the invention.

Roof ridge end caps of the invention each comprise a peak formed by angularly connected side panels, opposed and adjustable face panels that may be moved apart or together to adjust the angle at the peak and a tail portion, each of which provides a further covering function to the area around a roof peak. The roof ridge end cap is formed with an acute angle between the edges of the front side walls that form the peak of the roof ridge end cap. The side walls overhang and overlap the side wall of a roof gable. The devices characterized in this disclosure present a further improvement over the device described and claimed in U.S. Pat. No. 9,631,368. The presently claimed device comprises two side panels that are curved and tapered from the front edges thereof toward the back, to form a tail portion. These same side panels are conjoined at their upper edges to form a peak co-extensive with a ridge, and the front edges of the side panels taper backward down from this peak so that the side profile of the peak itself is acutely angled downward from the top toward the ends of the lower edges of the side panels, as is shown in FIG. 5.

Figure 1:
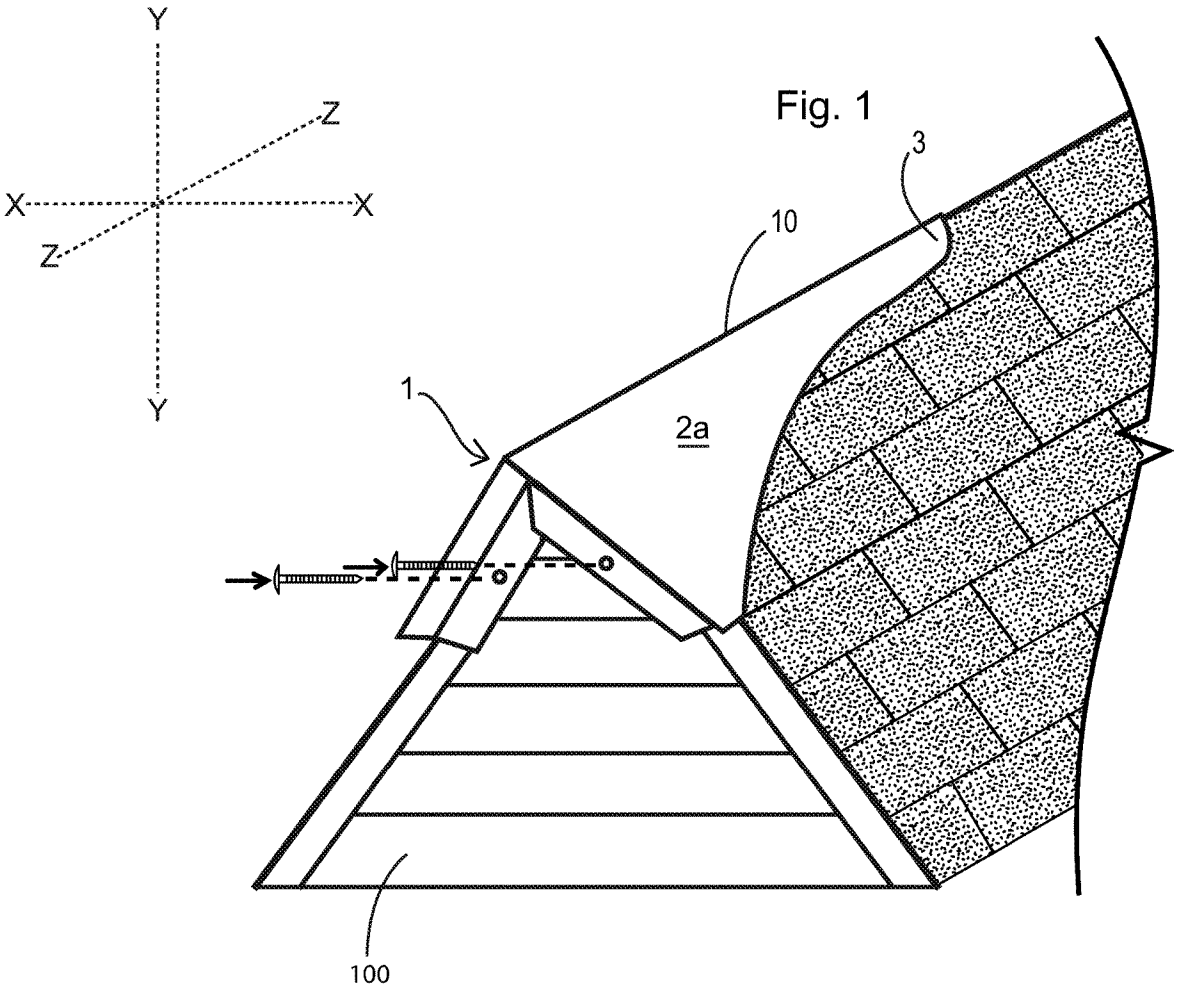
FIG. 1 is a perspective view of a roof gable fitted with a roof ridge end cap according to the invention.

According to FIG. 1, a roof ridge end cap 1 of the invention is fitted over the peak of a roof gable 100. The roof ridge end cap 1 in this respect comprises a central ridge 10 formed at the peak where the top edges of side panels 2*a* and 2*b* (not shown) meet and connect at an angle. Roof ridge end cap 1 further comprises a tail portion 3 which is distal from the face panels and straddles either side of the roof ridge. In this respect, the tail portion typically extends toward but does not cover any ridge vent (not shown) that may be installed at the roof ridge. It should be noted that the ridge vent is a relatively new feature in roof construction that allows an asphalt-shingled vent with breathing apertures to be installed over the roof ridge so as to vent hot air that accumulates in the attic beneath the roof. The roof ridge end cap of the invention can be installed in close proximity to a ridge vent without interference; however the tail portion is narrow enough that it can cover the end of a ridge vent without interfering with the ridge vent's operation. One or more roof ridge end caps may be installed on a roof having multiple gables.

Figure 2:
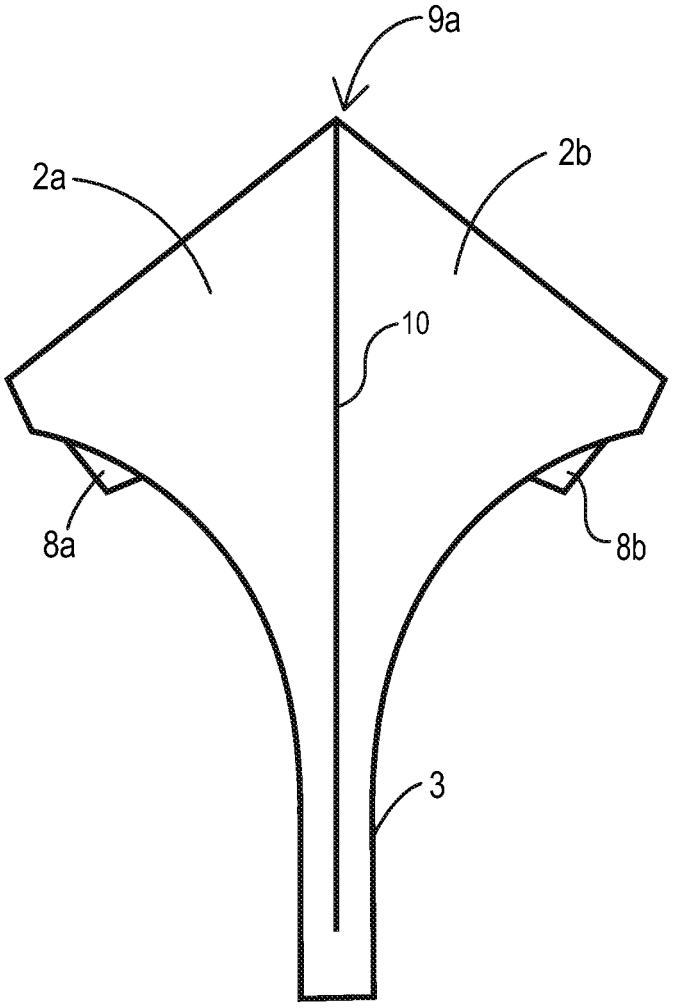
FIG. 2 is a top view of a roof ridge end cap according to the invention.
Figure 3:
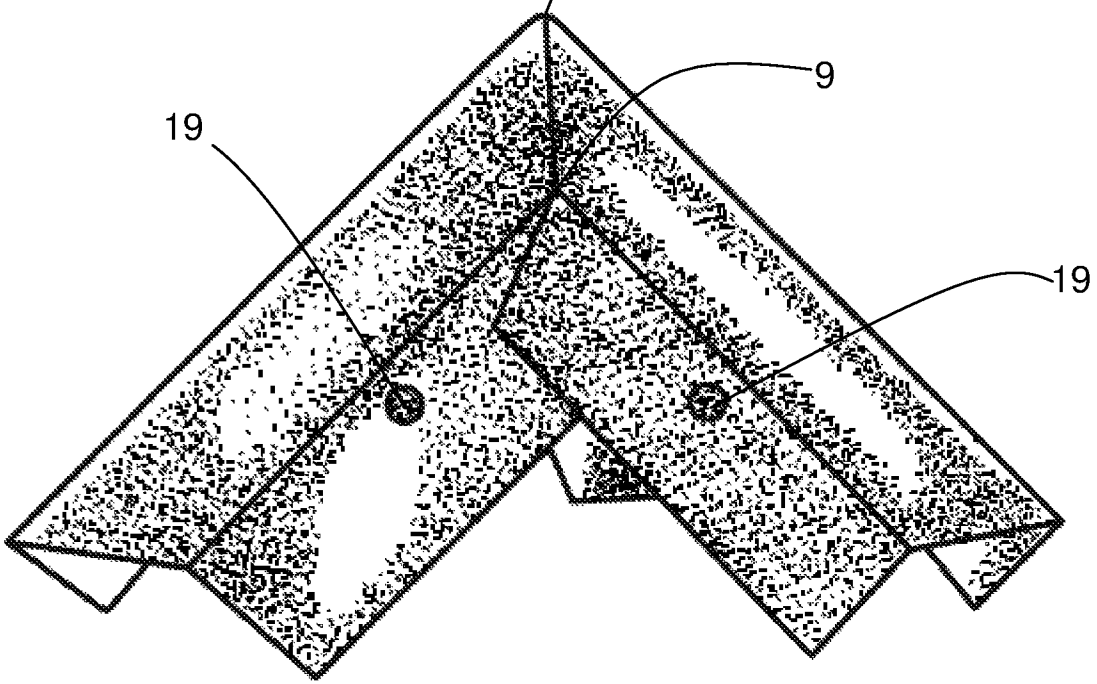
FIG. 3 is a front, three-dimensional representation of a roof ridge end cap according to an embodiment of the invention.
Figure 4A:
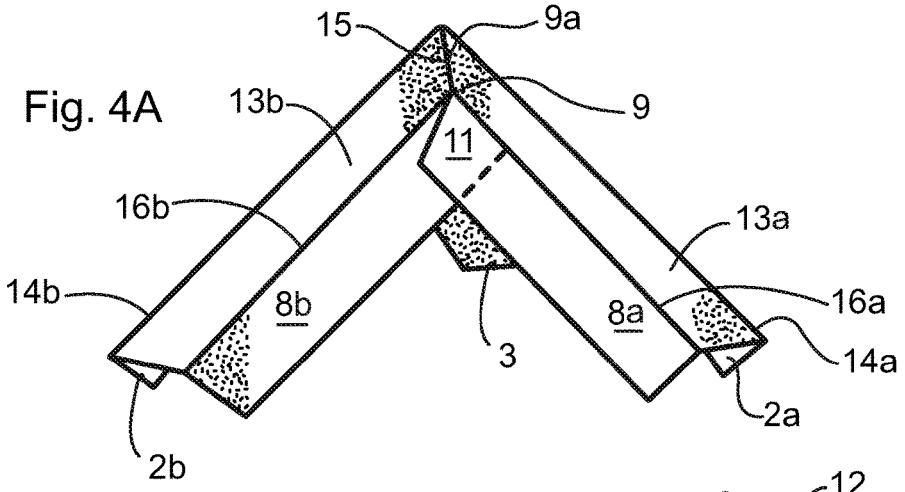
FIG. 4A is a front view of the invention showing the intersection of the face panels.
Figure 4B:
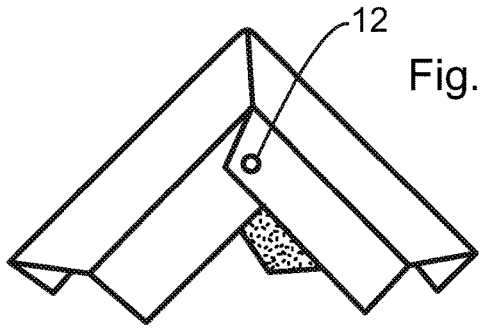
FIG. 4B is a front view of the invention showing a single pushing screw attachment point.
Figure 4C:
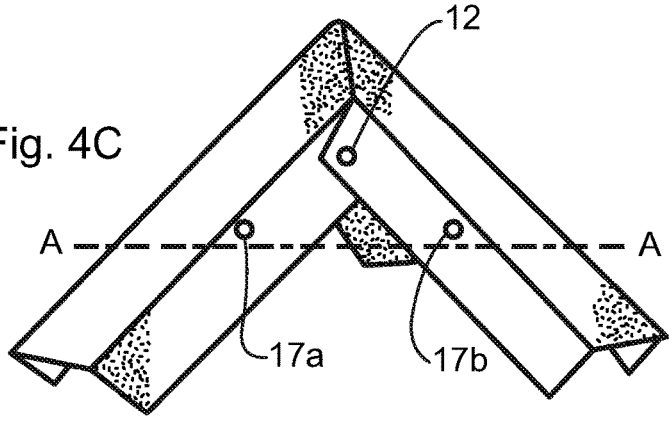
FIG. 4C is a front view of the invention showing multiple screw attachment points.

FIG. 2 represents a roof ridge end cap that comprises side panels 2*a*, 2*b* which are joined at their top edges to form a peaked ridge 10 which terminates at a peak extension 9*a*. The ridge 10 defines the separation between the face panels and it is aligned with the roof ridge of the gable when the cap is to be installed. The ridge 10 terminates toward the tail portion 3, which is of a narrower width than the combined panels 2*a*, 2*b*. In the top view of FIG. 2, the ends of the face panels 8*a* and 8*b* are positioned approximately perpendicularly to the plane of the side panels 2*a*, 2*b*. The face panels are overhung by hood extensions which shield the face panel from the birds' perching or pecking, and also from water ingress in wet weather. The element 9*a* is a further extension of the peak 9 (shown in FIG. 4A) and is formed by the angular connection of the hood extensions. It should be noted that the edges of the side panels 2*a* and 2*b* are angled backward from the tip of the peak extension 9*a*. This creates an angled shape of the roof ridge end cap which is an important feature to the installation methods. FIG. 3 represents a roof ridge end cap according to the invention in which attachment screws 19 are used to fasten the roof ridge end cap in place. As shown in FIGS. 3 and 4A, face panels 8*a*, 8*b* of the roof ridge end cap overlap at intersection area 11. The degree of overlap is altered by adjusting the distance between the face panels 8*a*, 8*b*, and these panels can be adjusted to widen the peak angle at the ridge 10 of the roof ridge end cap so it will correspond to the angle of the roof ridge over which it is to be installed. Hood extensions 13*a*, 13*b* are formed as inward folds of the edges of the side panels first along fold lines 14*a*, 14*b* and then along fold lines 15, 16*a*, 16*b*. Hood extensions 13*a*, 13*b* thus connect at the peak 9 and form peak extension 9*a*. The hood extensions 13*a*, 13*b* according to this configuration form an overhang or a ledge over the face panels 8*a*, 8*b*. According to FIG. 4B, a single point of attachment may be provided by a screw hole 12 sized to accommodate a screw that attaches the roof ridge end cap 1 to the structure 100 of the building to which the roof ridge end cap is attached. In alternate embodiments, multiple attachment points are provided. In an embodiment according to FIG. 4C, in addition to the single point of attachment in the intersection area 11, bilateral attachment points are provided, typically above the center line axis of the roof ridge end cap. It should be understood that other configurations, for example attachment points above the center line axis could also be employed depending on the size and the peak angle of the roof ridge end cap. In a preferred embodiment as shown in FIG. 3, there are two oppositely located attachment points 17*a*, 17*b*, one in each face panel above the center line axis X-X. It should be understood that these lower face panel attachment points such as those represented by elements 17*a*, 17*b* could also be located below the center axis line X-X. A novel feature of the invention with respect to the installation is that as the roof ridge end cap is fastened via these attachment points to the building structure, for example preferably above the center line axis X-X, the attachment means, such as screws, the directed movement of the screws cause the tail portion 3 to be pushed downward onto the ridge of the roof and locked tightly into that position. The shape of the roof ridge end cap 1 facilitates this angular displacement in several ways. First, the cap itself is formed with peak 9 at an angle in relation to the front edges of the side panels 2*a*, 2*b*. According to the embodiment of FIG. 5, the lower edges of the side panel 2*a* cuts away and downward at an acute angle in relation to the peak of the roof ridge end cap as represented by peak extension 9*a*. The side edges 7 of the side panels are curved or angled to taper upward toward the peak, forming a tail portion 3 that is narrower than the front portions of the side panels. The front edges of the side panels 2*a*, 2*b* are angled beneath the peak extension 9*a* to form an acute angle A such that the tip of the peak extension 9*a* and also the peak 9 which is obscured in the FIG. 5 view, juts out above and beyond the front edges of the side panels. In this manner, when the roof ridge end cap is placed over the roof peak there is gap 110 beneath the peak 9 of the roof ridge end cap which creates an area for displacement (shown in FIG. 6) between the inside of the peak of the roof ridge end cap and the roof peak. As the roof ridge end cap is being attached to the front fascia of a roof peak, the attachment means, such as self-tapping or self-drilling screws, metal piercing screws, roofing screws, nails, exposed fasteners, hidden fasteners, or other fasteners, is pushed through this gap 110 in a clockwise turning motion. Here, "clockwise" is meant movement in a forward clockwise roll through a center axis. This movement forces the peak of the roof ridge end cap clockwise and at an angle in the direction of the screw movement, and the roof ridge end cap is thus pushed closer and onto the roof ridge 120 of the building structure. At the same time, the tail portion 3 of the roof ridge end cap is pushed further along and closer to the top of the roof ridge 120. When the screw is fully tightened, the tail is pressed tightly against the roof ridge. Alternately stated, at the start of installation the bottom of the roof ridge end cap is fixed against the fascia of the building structure wall but the top (roof ridge end cap peak) is being pushed forward by the attachment screw to rotate along a center line Z-axis. After the top portion of the cap touches the roof it begins to tighten and is locked in place by the screw tightening the gap between the building structure and the base of the roof ridge end cap.

In the methods of installing the roof ridge end caps of the invention to prevent roof deterioration from the pecking of birds, the roof ridge end cap is placed over the roof peak and the face panels moved apart or pushed closer together to form an angle at the top of the roof ridge end cap that corresponds to the roof peak. Because of the acute angle formed between the side panels and correspondingly receded lower portions of the face panels, the peak 9 of the roof ridge end cap protrudes outward beyond the peak of the roof gable on a Z axis. (The axes designated X, Y and Z herein approximate the three-dimensional axes commonly referred to in the system of Cartesian coordinates.) As a result, when the roof ridge end cap is placed over the terminal end of the roof gable's peak, the peak 9 and the peak extension 9*a* jut forward along axis Z and overhang the lower areas of the face panels 8*a*, 8*b*. The difference in area beneath the peak 9 and the peak of the roof at roof ridge 120 form the displacement gap 110. Attachment means such as a pushing screw 18, which is inserted through the intersection area 11 formed by the overlap of the face panels, then moves through the displacement gap 110 to fix the roof ridge end cap onto the roof ridge, as described above. In certain embodiments, for example at FIG. 4A, a single pushing screw of appropriate length is inserted through the layers of the roof ridge end cap and the layers of the roof through the intersection area 11 formed between the face panels at hole 12. The screw hole 12 can be cut before the screw is installed, or the pushing screw 18 can be forced through the intersection area 11 using a powered screwdriver. The screw is pushed along a straight line direction that is about parallel to the roof ridge and the Z-axis, and approximately perpendicular to the face panels. Because the screw moves through the gap 110 which provides a higher elevation of the peak of the roof cap in relation to the tail portion 3, pushing the screw along this straight line path forces the cap onto the roof ridge and causes a downward pressure to be applied to tail portion 3. As a result, the tail is pushed tightly into place over the roof ridge, and the peak 9 of the roof ridge end cap is also pushed against the point of the roof peak. When applied in this manner, the roof ridge end cap acts as a secure, impenetrable cover for the roof peak. It is not affected by high winds. In comparison, it is known in the roofing field that even winds of 20 miles per hour or less can cause shingles to be loosened or lifted off entirely. Shingles at the roof edge are especially susceptible to wind. The invention therefore provides a distinct advantage in that it protects the vulnerable edge shingles at the roof peak from lifting or blowing off in windy conditions. Another advantage of the roof ridge end cap and method of installation according to this invention, the tail portion and tail plate cover a section of the ridge vent at the roof peak, which is typically where the final layers of shingles are installed. Nails are used to secure each shingle in each layer up the slope of the roofing panels, and as a result the final shingles in the layer at the uppermost portion of the roof, in the area of the roof peak, has nail heads that are exposed and not covered by another layer of shingles. These nails have to be caulked so they will not become points of weakness that allow water entry. In some cases the junction between the upper shingle layers at the tops of the roofing panels is covered by a ridge vent, which spans the junction between the tops of the panels. The ridge vent has vents along its length to allow airflow from beneath the roof. However, the ridge vent is itself nailed in place and so also has exposed nails. The roof ridge end cap of the invention covers a length of the ridge, and can also be installed over the top of the ridge vent and the exposed nails at the top of the roof peak. Not only does this prevent the nails from being loosened and dislodged, the roof ridge end cap also provides a covering from rain so that water cannot seep into the nail holes. Furthermore, even if the roof ridge end cap could be penetrated by bird pecking, the displacement gap 110 that exists between the inside of the roof ridge end cap's peak 9 and the tip of the roof peak actually further protects the roof tip from bird access and resulting bird damage.

Figure 6:
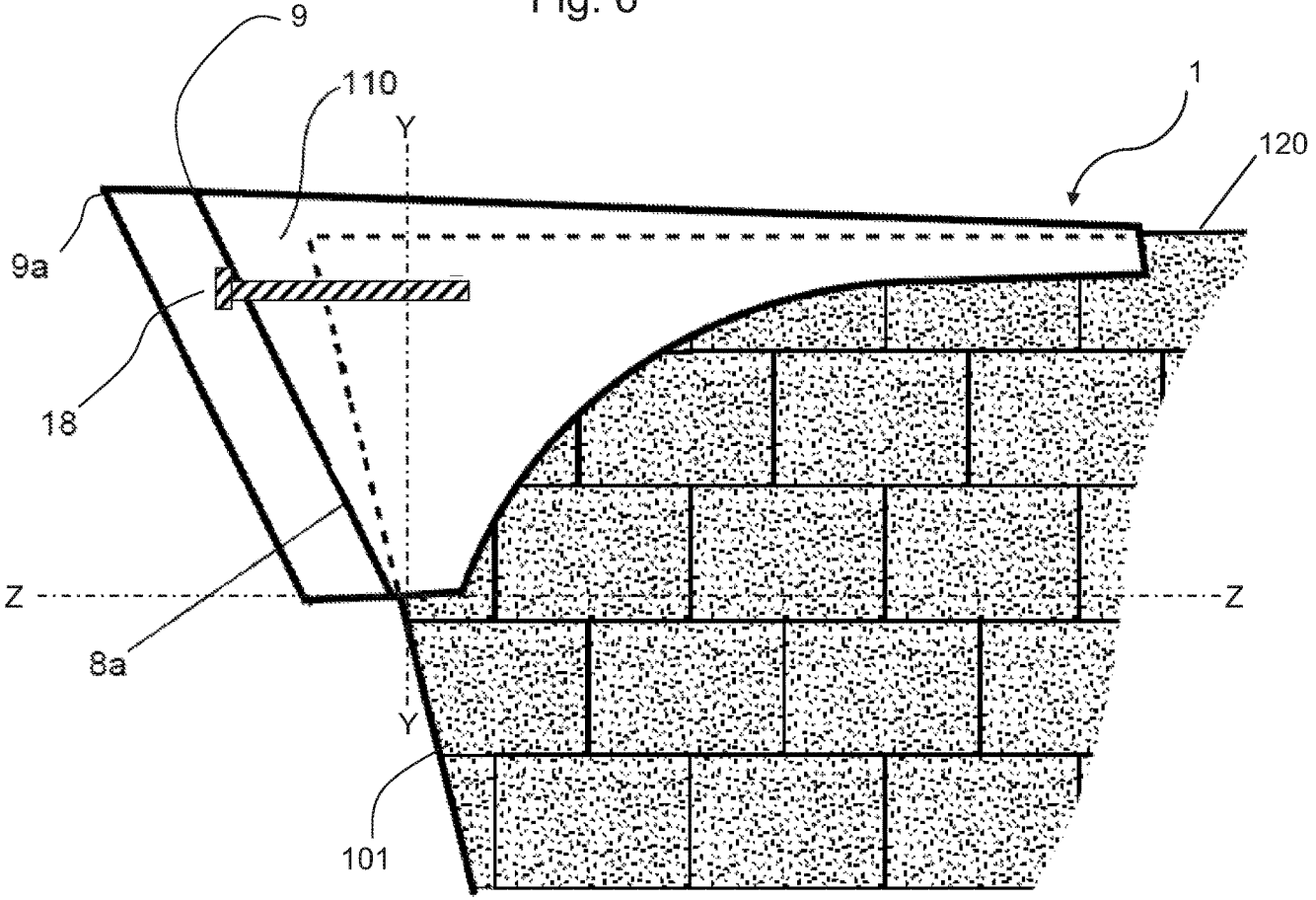
FIG. 6 is a transparent side view of a roof ridge end cap installation according to the invention.

As seen in the transparent view of FIG. 6, the side panels 2*a*, 2*b* (the latter shown in FIG. 2) join at the ridge 10. The roof ridge end cap peak 9 as well as the peak extension 9*a* formed at the ridge 10 are angled in relation to the top of the roof ridge. Because of this angled configuration, an angled displacement gap 110 is formed in which the portion of the roof ridge end cap that is closest to the face panels is elevated above the surface of the roof ridge 1 while the tail portion 3 is touching the roof. The gap formed by the difference in angles of the roof in relation to the inner surface configuration of the roof ridge end cap's peak is typically acute and extends outward and away from the front fascia 101 of the roof gable. In FIG. 6, the angular difference created by the gap 110 is defined along axes Z-Z and Y-Y. When pushing screw 18 is inserted and screwed into the face plates, suitably through screw hole 12 located within the intersection area 11 (shown at FIG. 4B), it pushes the roof ridge end cap along the Z-axis trajectory onto the roof surface. Since the tail portion 3 is already touching the roof surface before the screw installation begins, tightening of the pushing screw tightens the front of the roof ridge end cap against the fascia 101 of the eave and tightens the tail portion 3 against the roof ridge 120, thereby firmly securing the roof ridge end cap over the tip and a length of the roof peak. The pushing screw as well as any additional attachment screws may be selected from self-tapping or self-drilling screws, metal piercing screws. In addition to screws, nails, exposed fasteners, hidden fasteners, or other fasteners used in the field of roof construction may suitably be used to attach the roof ridge end cap to the building structure.

Figure 7:
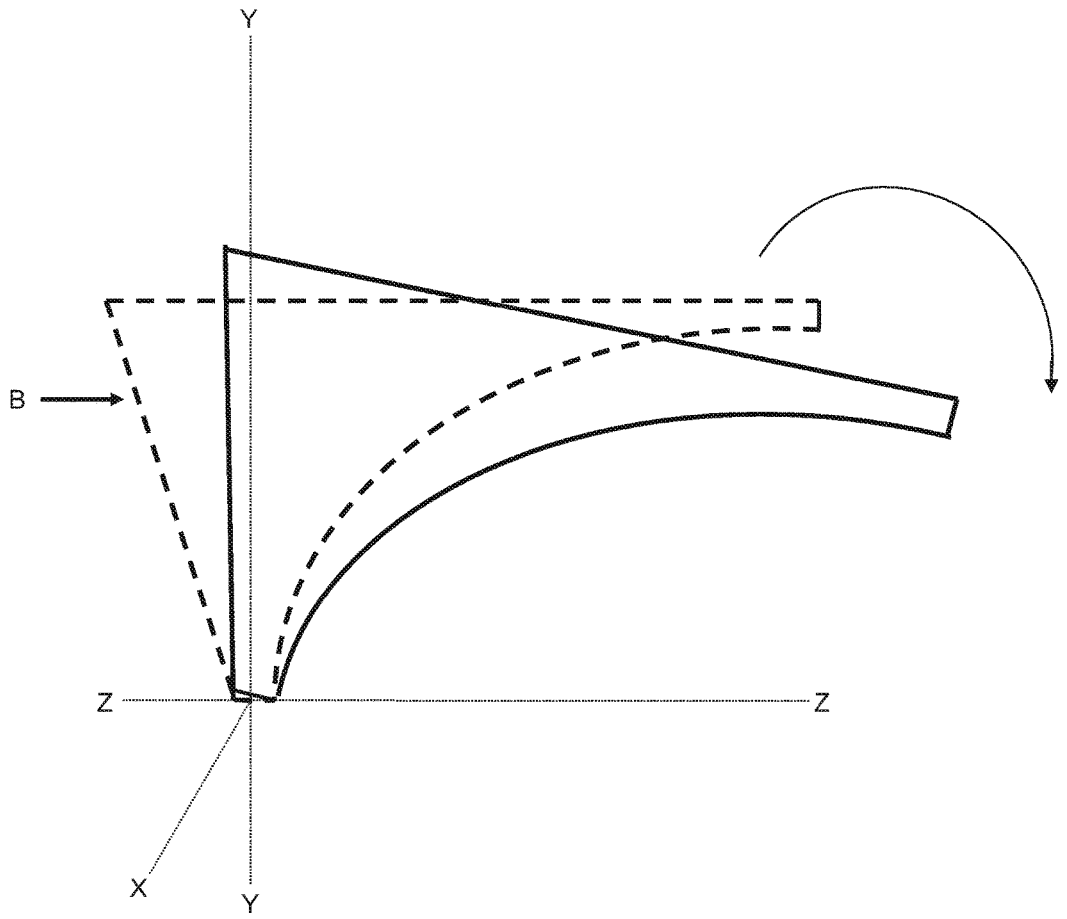
FIG. 7 is a side view of a roof ridge end cap according to the invention which shows the clockwise rotation about an X-axis as it is being installed.

FIG. 7 indicates the direction of movement of the roof ridge end cap during the method of installation. While the front of the roof ridge end cap is centered along the third dimensional axis Z, it is positioned over the fascia of the roof gable at the tip of the peak. It should be noted in this regard that the cap may initially be positioned slightly counter-clockwise in relation to the roof tip, when the installation is complete the peak of the roof ridge end cap will be geometrically aligned with the tip of the roof peak for a symmetric and aesthetically pleasing appearance. The attachment means, such as a pushing screw otherwise described herein, is applied and pushed forward along direction B into the front of the roof ridge end cap. As this pushing occurs, the roof ridge end cap is moved by the clockwise rotational force of the pushing screw to also displace and move slightly in a clockwise direction from its initial position. The angle of displacement is determined by the initial position of the cap and the tightness applied to the pushing screw, however as an example only, the roof ridge end cap could be displaced 15° to 45° during the installation process. As mentioned previously, the ultimate objective is to seat the cap neatly and in alignment with the roof peak.

The roof ridge end caps of the invention are constructed of a rigid material with limited flexibility. Preferred materials include but are not limited to durable, non-corrosive metals such as aluminum, stainless steel, galvanized metals or copper. The metal should be impenetrable to bird pecking and resistant to weather elements. Provided it is of suitable durability and resistance to bird pecking, the metal may also be decorative, for example hammered copper or tin. The roof ridge end caps of the invention may also be painted to match or complement the roofing materials used in the construction of the roof. Durable, bird-impenetrable and weather resistant plastics or composite materials are also contemplated within the scope of this disclosure.

The various embodiments of the invention may be used as a protective element on residential or commercial roofing structures. Multiple end caps may be used on a single building. It is an advantage of the claimed invention is that the roof peak is securely protected from bird damage without nails or screws having to be inserted into the shingles and roof panels that form the roof gable and peak. In certain embodiments, only one screw is required to attach the roof ridge end cap to the roof structure. Further, the hood extensions of the cap over the face panels provide further protection from water ingress around screw or nail holes. The configuration of the roof ridge end cap peak and the displacement gap also provide secondary protection from bird damage, as discussed previously.

The foregoing specification and examples provide an enabling description of the method of manufacture and comestible products of the invention. Many embodiments can be made without departing from the spirit and scope of the invention and this disclosure, including those represented by the appended claims.

INDUSTRIAL APPLICABILITY

The devices and methods of the invention find applicability in the field of roofing construction, particularly in the construction or repair or preventive maintenance of roofs susceptible to bird damage such as asphalt or composite-shingled roofs.

The invention claimed is:

1. A roof ridge end cap for protecting an end of a roof-ridge of a building structure comprised of:

a. two side panels, each comprising a front edge, a top edge and a side edge, wherein the two side panels are joined at the top edges thereof at an angle to form a ridge; the side edges face each other at opposite sides of the ridge; and the front edges are connecting the ridge to the two opposing side edges;

b. two face panels, each of which is attached to the front edge of one side panel, wherein the two face panels intersect at an intersection area, and further wherein the two face panels move cooperatively one in relation to the other to narrow or widen the angle between the side panels; and c. a tail portion distally located from the front edges of the side panel and opposite to the two face panels, and wherein the side edges of the two side panels are curved so that a distance from the ridge to each side edge is progressively shortened in relation to the front edge to form said tail portion;

wherein the ridge of the roof ridge end cap and a plane consisting of the two front edges of the side panels form an acute angle.

2. The roof ridge end cap of claim 1 wherein the intersection area comprises a screw hole for receiving an attachment screw.

3. The roof ridge end cap of claim 2 further comprising additional screw holes in the face panels.

4. The roof ridge end cap of claim 1 further comprising two hood extension panels, each of which is an extension of the front edge of one of said side panels and a top edge of one of said face panels, and the hood extension panels are joined at the roof ridge end cap peak to form a hood that overhangs and shelters the intersection area between the face panels.

5. The roof ridge end cap of claim 1 wherein the side edge of each side panel is curved or an angled straight edge.

6. The roof ridge end cap of claim 1, which is formed from a durable metal substrate.

7. The roof ridge end cap of claim 6 wherein the durable metal substrate is selected from galvanized metals, aluminum, stainless steel or copper.

8. A system for protecting an end of a roof ridge of a building structure comprising:

a. a building structure that includes opposed slopes a roof, said opposed slopes being connected at their top to form a roof ridge, and a fascia connecting the opposed slopes at an end of the roof ridge; and b. a roof ridge end cap comprised of:

two side panels, each comprising a front edge, a top edge and a side edge, wherein the two side panels are joined at the top edges thereof at an angle to form a ridge; the side edges face each other at opposite sides of the ridge; and the front edges are connecting the ridge to the two opposing side edges;

two face panels, each of which is attached to the front edge of one side panel, wherein the two face panels intersect at an intersection area, and further wherein the two face panels move cooperatively one in relation to the other to narrow or widen the angle between the side panels; and a tail portion distally located from the front edges of the side panel and opposite to the two face panels, and wherein the side edges of the two side panels are curved so that a distance from the ridge to each side edge is progressively shortened in relation to the front edge to form said tail portion;

wherein the ridge of the roof ridge end cap and a plane consisting of the two front edges form an angle that is smaller than an angle between the roof ridge and the fascia.

* * * * *